United States Patent [19]

Jones

[11] Patent Number: 4,683,946

[45] Date of Patent: Aug. 4, 1987

[54] METHOD AND APPARATUS FOR THE INSTALLATION AND MODIFICATION OF OIL WELL EVACUATION SYSTEMS

[75] Inventor: Brian D. Jones, Bakersfield, Calif.

[73] Assignee: Strategic Energy Services, Inc., Bakersfield, Calif.

[21] Appl. No.: 797,368

[22] Filed: Nov. 12, 1985

Related U.S. Application Data

[63] Continuation-in-part of Ser. No. 576,970, Feb. 3, 1984, Pat. No. 4,552,220.

[51] Int. Cl.[4] ..... E21B 37/02

[52] U.S. Cl. ..... 166/170; 166/177

[58] Field of Search ..... 166/369, 177, 176, 170; 198/702

[56] References Cited

U.S. PATENT DOCUMENTS

| | | |
|---|---|---|
| 55,178 | 5/1866 | Towle . |
| 155,965 | 10/1874 | Newhall . |
| 587,124 | 7/1897 | James . |
| 727,127 | 5/1903 | Gray . |
| 762,808 | 6/1904 | Cushing et al. . |
| 769,014 | 8/1904 | Pedley . |
| 831,448 | 9/1906 | Leinweber . |
| 859,402 | 7/1907 | Middleton . |
| 994,487 | 6/1911 | Vaichis et al. . |
| 1,007,282 | 10/1911 | Hawley . |
| 1,017,847 | 2/1912 | Carl . |
| 1,153,416 | 9/1915 | Bemiss et al. . |
| 1,230,666 | 6/1917 | Carden . |
| 1,304,033 | 5/1919 | Edmondson . |
| 1,389,428 | 8/1921 | Gartling . |
| 1,425,112 | 8/1922 | Long . |
| 1,481,735 | 6/1924 | Peck . |
| 1,511,506 | 10/1924 | Cortes . |
| 1,540,681 | 6/1925 | Detaint . |
| 1,703,963 | 3/1929 | Scruby . |
| 1,740,821 | 12/1929 | Kneuper . |
| 1,763,395 | 6/1930 | Frederick . |
| 1,769,336 | 7/1930 | Detaint et al. . |
| 1,868,219 | 7/1932 | Parker . |
| 2,066,152 | 12/1936 | Laughlin ..... 198/702 |
| 2,329,913 | 9/1943 | Kizziar . |
| 2,438,298 | 11/1948 | Reed . |
| 2,576,992 | 12/1951 | Bainbridge et al. . |
| 2,662,486 | 12/1953 | Hillger . |
| 2,704,981 | 3/1955 | Gustafson . |
| 3,289,593 | 12/1966 | Corry . |
| 3,372,791 | 3/1968 | Kennedy, Jr. . |
| 3,774,685 | 11/1973 | Rhodes . |

*Primary Examiner*—Stephen J. Novosad
*Assistant Examiner*—William P. Neuder
*Attorney, Agent, or Firm*—Knobbe, Martens, Olson & Bear

[57] ABSTRACT

A self contained vehicle is disclosed for the installation of a endless belt type oil well evacuation system, and for the modification of previously installed systems. The vehicle is provided with lifting means and rotational supply means for the endless belt in order to facilitate the feeding out and taking in of the belt material. The rotational supply means is provided with an automatic tension adjustment mechanism to avoid excess slack in handling the endless belt. A transverse adjustment mechanism is also provided to allow the endless belt to be lined up with the well head. Also disclosed is a drive unit to provide means for holding and driving the endless belt while installing or modifying the evacuation system. The belt is provided with a number of cups or transport units which are essentially three sided. One side of the cup is preferably soft and pliable in order to facilitate the evacuation of the cup. A well head station is disclosed which provides improved evacuation of the cups which, in turn, provide for the evacuation of the well.

7 Claims, 21 Drawing Figures

Fig. 1
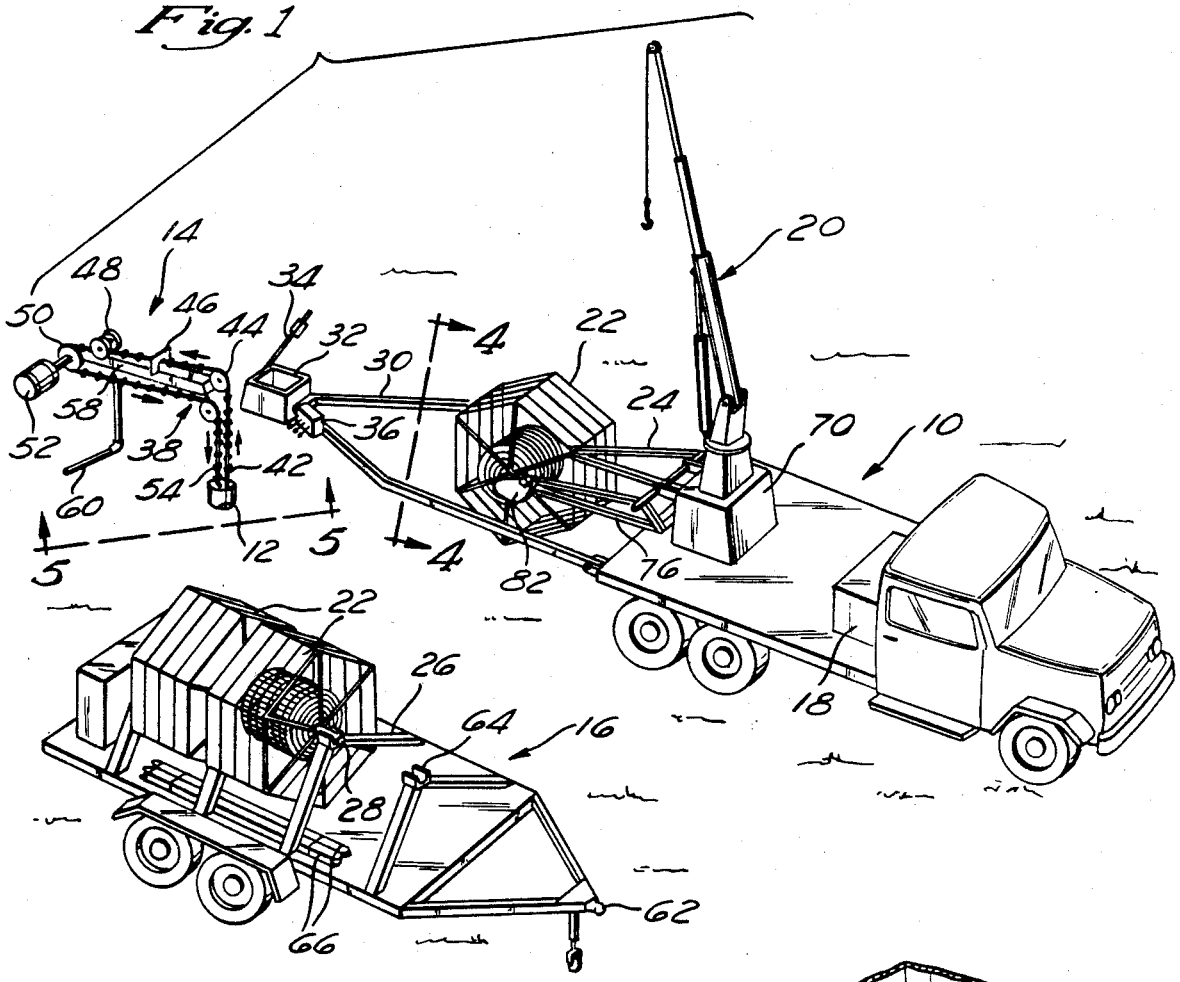
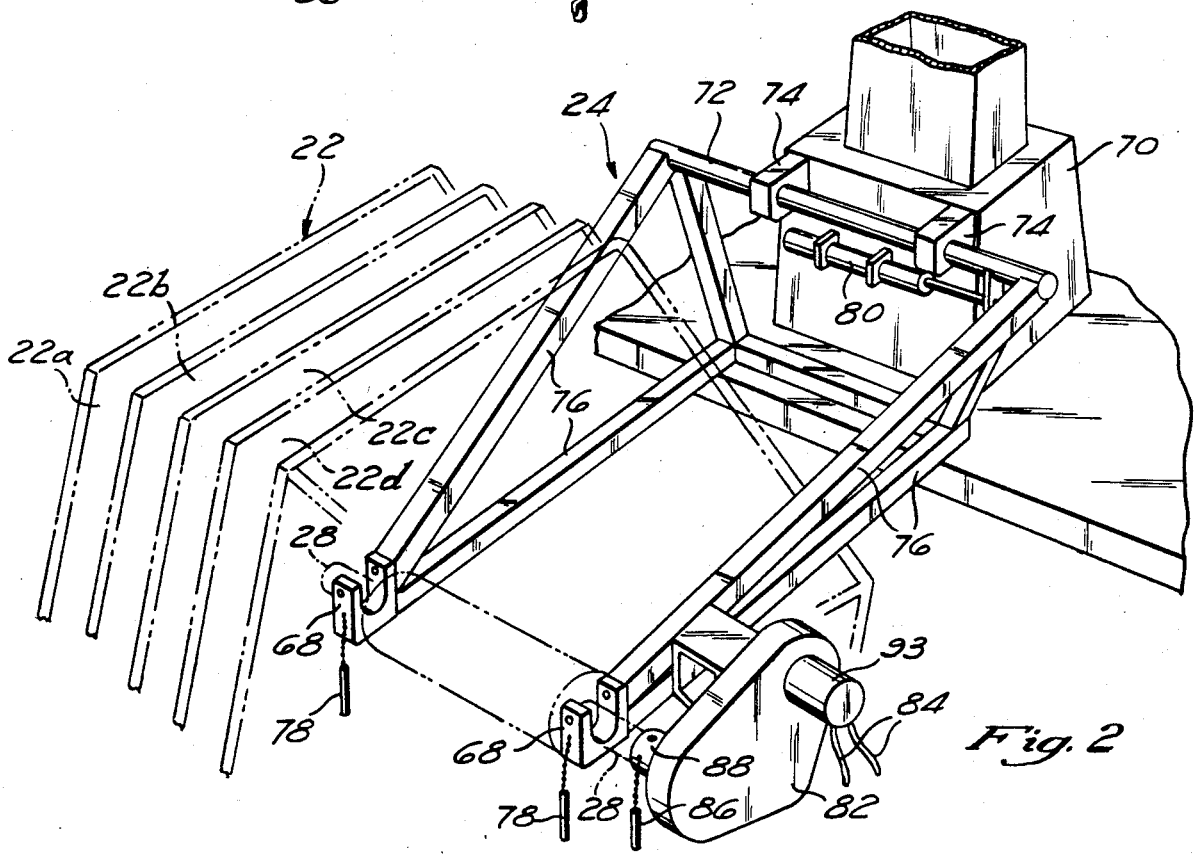
Fig. 2

Fig. 3a
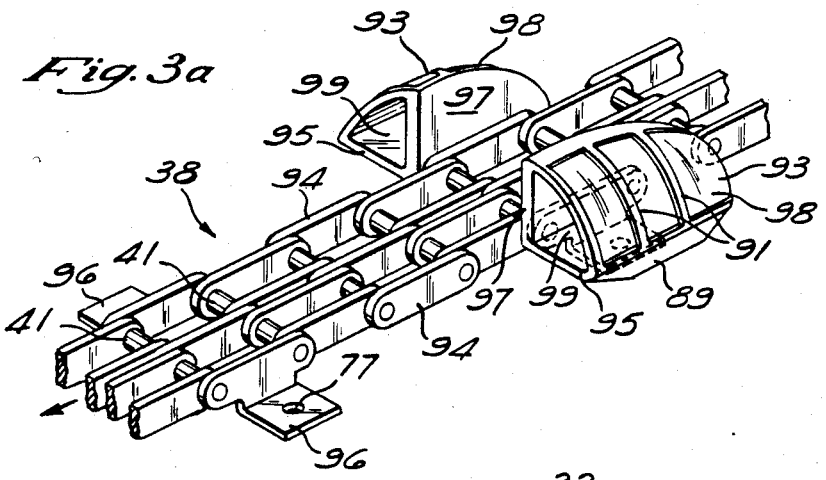
Fig. 3b
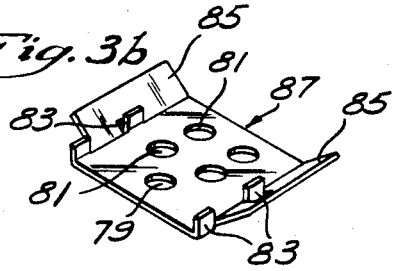
Fig. 4
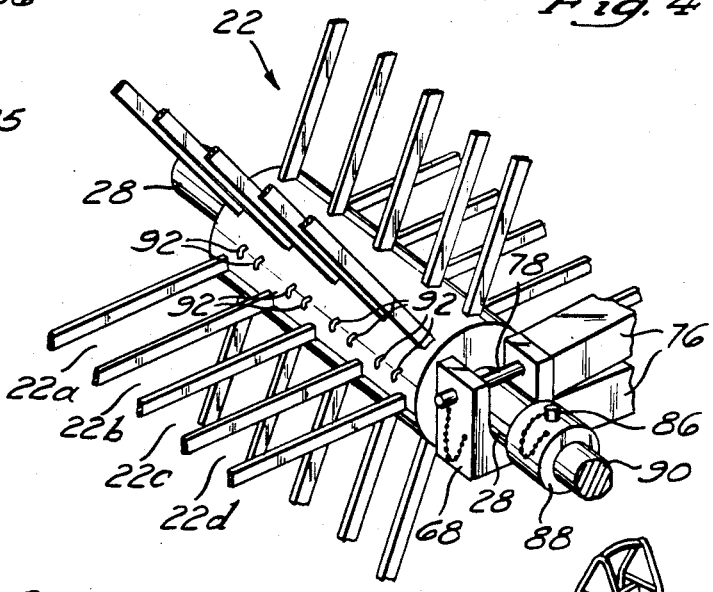
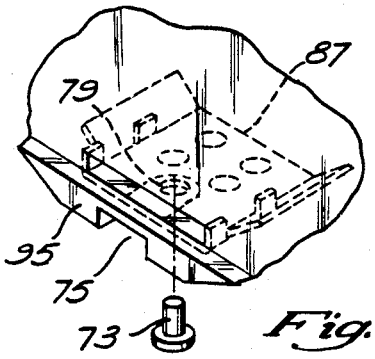
Fig. 3c
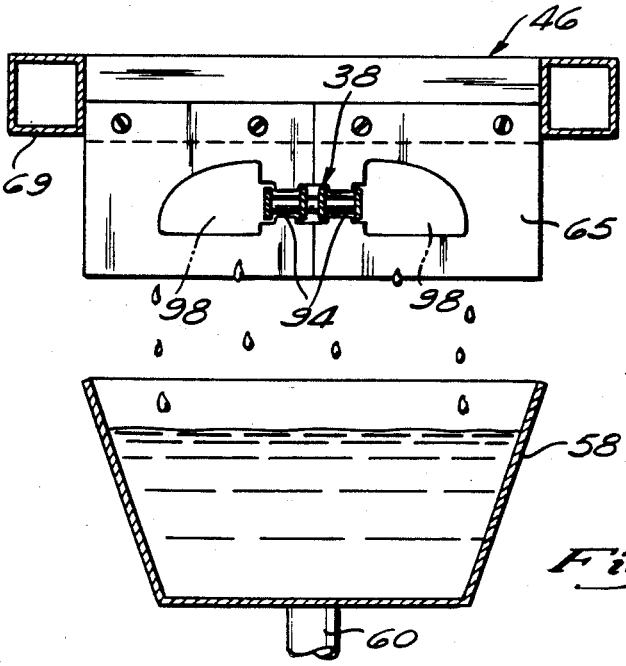
Fig. 6
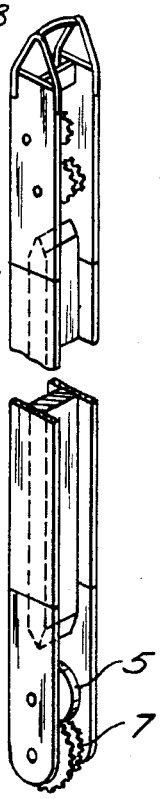
Fig. 16

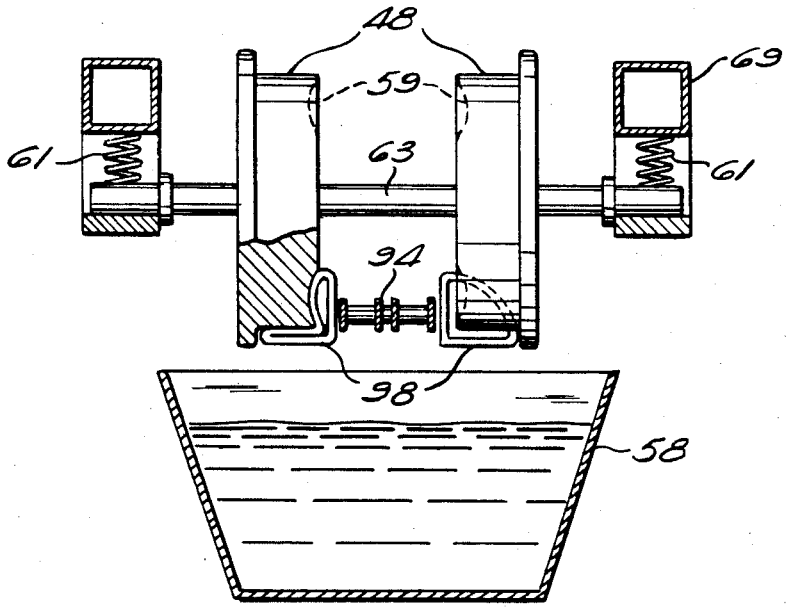
Fig. 7
Fig. 8
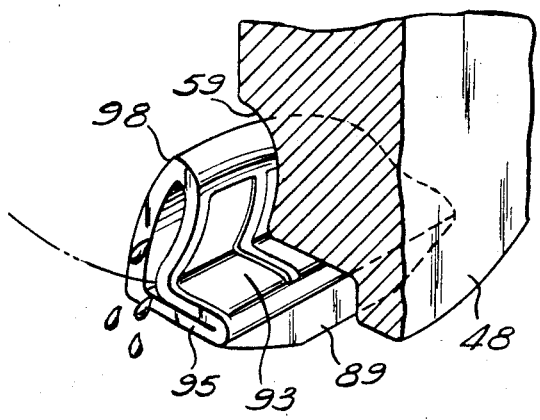
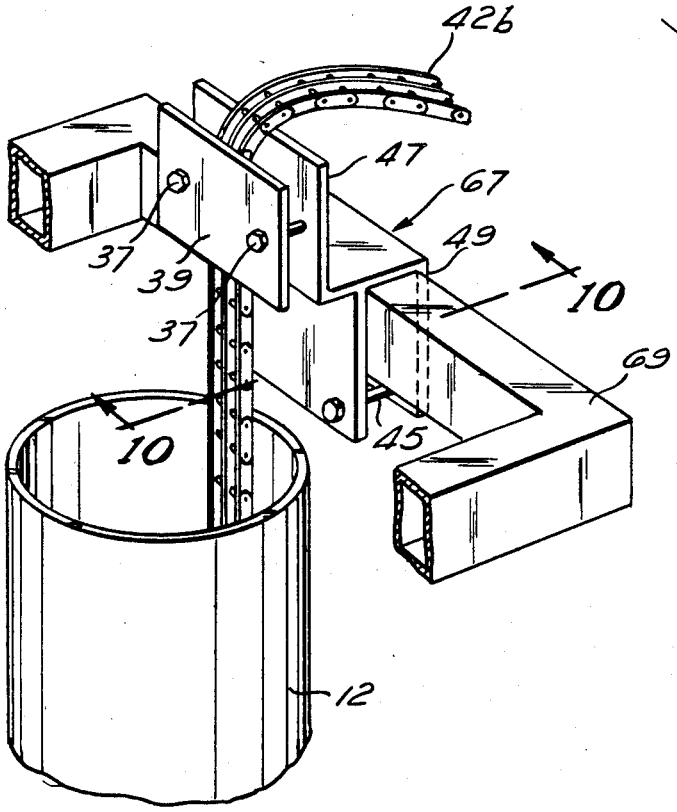
Fig. 9
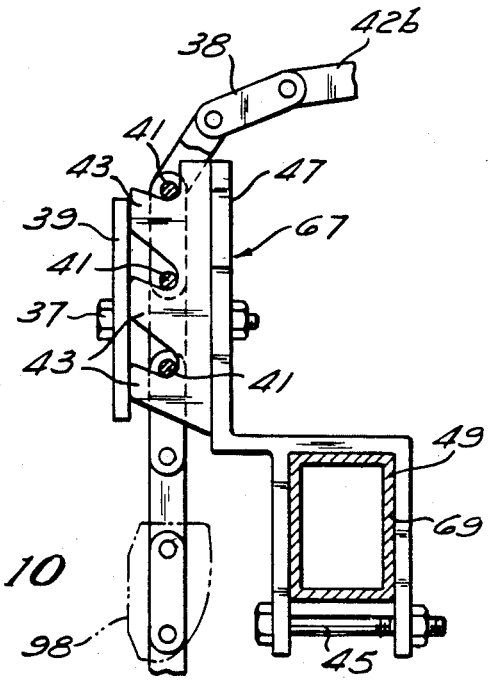
Fig. 10

METHOD AND APPARATUS FOR THE INSTALLATION AND MODIFICATION OF OIL WELL EVACUATION SYSTEMS

RELATED APPLICATION

This is a continuation-in-part application of Ser. No. 576,970, filed Feb. 3, 1984 entitled "OIL WELL EVACUATION SYSTEM", now U.S. Pat. No. 4,552,220, issued Nov. 12, 1985.

BACKGROUND OF THE INVENTION

Traditional artificial lift methods, such as the sucker rod system, have proven to be extremely inefficient and uneconomical in evacuating oil from low or marginally-producing wells. This problem is aggravated by the fact that a very high percentage of the producing oil wells in the United States fall into the low or marginally producing category.

Furthermore, sucker rod systems may cost as much as $100,000 and may have power requirements necessary to operate 10 or 40 horsepower motors. In addition, such systems are unable to remove sand, paraffin, and other non-petroleum solids from the well. These elements eventually prevent further oil production resulting in the shut-down of the well for two to three days for reworking. Obviously, such a shut down results in a significant loss of revenue to the oil well owner or leaseholder because of the cessation of oil flow. A large portion of this lost time is due to the time and labor necessary to remove the sucker rod system for reworking the well, and then replacing it.

Improved oil well evacuation systems have proven to be very efficient and economical in low and marginally producing oil wells. In the system disclosed in the above-referenced related application, an evacuation system utilizing an endless belt apparatus and method for accomplishing artificial lift are disclosed.

The endless belt is flexible and is driven between a well head station at the surface of the ground and a down hole module located near the bottom of the well. The belt carries transport units or cups which efficiently evacuate oil, water, sand, and other oil production by-products from the well as the belt is power-driven down to a level near the bottom of the well, through the down hole module and then returned to the well head station. The well head station comprises generally a container supported by a frame which is mounted near ground level on the well head. The station includes a motor and sprocket system for driving the endless belt through the course just described.

Also comprising the well head station are a number of apparatus designed to remove oil and other by-products from the inside and outside of the transport units and belt. The down hole module is located near the bottom of the well and serves as a turn-around station for the endless belt. It also assists in the excavation of the oil well.

Since the oil production may be at depths as low as 2,000 feet, the weight of the belt itself, in an endless belt system, is a significant factor to contend with. While the belt is completely joined in the endless configuration, the weight on one side of the belt, that is going down into the well, is balanced by the other side of the belt which is emerging from the well. For convenience, these two portions of the belt can be referred to as the "entrance side" and "exit side," respectively, of the endless belt. However, as soon as the endless belt is broken, for example in order to initially install the evacuation system in the well, or to modify it in any way, then this balance is lost. Furthermore, while in the balanced condition, very little power is necessary to drive the endless belt. Obviously, when the endless belt is broken, either in the installation or modification of the system, each of the broken ends must be securely held to prevent the weight of either side of the belt from causing it to fall to the bottom of the well by force of gravity.

Producing oil wells are frequently found in remote locations which are difficult to reach. The terrain surrounding the oil well may be hilly or rough, further complicating the servicing of the oil well evacuation systems.

Thus, a need has arisen for facilitating the installation and modification of such endless belt systems, and for improving their performance.

SUMMARY OF THE INVENTION

The present invention comprises a self-contained, mobile vehicle for the installation of endless belt-type oil well evacuation systems, and for the modification of previously installed systems. Preferably, the vehicle takes the form of a truck having a flat bed on which are mounted apparatus for facilitating the performance of various operations on the endless belt systems. In the performance of the method of the present invention, the truck is parked adjacent the well head to facilitate the use of its accompanying apparatus.

Such apparatus includes a large, multi-compartment reel for the storage and take-up of the endless belt. Preferably, such a belt takes the form of a double-pitch roller chain, although other belt types are possible. The belt serves as a "transporter" for the cups or "transport units" which evacuate the well, although the transporter itself also carries a significant amount of oil to the surface, as described below in more detail. The reel is mounted on the vehicle for rotation in either direction and for translation to facilitate alignment of individual compartments with the well head.

A rear, generally V-shaped boom provides a mounting for an S-drive unit mounted directly to the well head station and the oil well evacuation system. This S-drive unit provides a positive holding and driving function for the installation and modification of the transporter when it is in a non-endless or broken condition. The belt is actually fed through a pair of adjacent sprockets which provide holding and driving functions. Associated with the S-drive unit are a pair of holding devices, one fixed, and one moveable, which provide positive holding for the broken ends of the transporter during initial installation or modification of the belt system.

Also mounted on the vehicle is a large crane for facilitating the mounting of the S-drive unit, the transporter reel and wellhead unit. A trailer is provided with the vehicle for the transportation and storage of extra reels, the well head station, and the down hole module. The vehicle is provided with a hydraulic system for powering the operation of the reel, S-drive unit, and crane.

The S-drive unit is advantageously provided with a unique hydraulic braking system and dead-man safety controls. To avoid damage to the system, or injury to its workers, the S-drive unit is provided with a hydraulic brake for providing positive holding force for one of the ends of the transporter when in a non-endless condition. The two adjacent sprockets of the S-drive unit are each mounted on a common shaft with engaging gear drives which provide both holding and driving. The S-drive unit is also provided with a hydraulic pressure gage to inform the operator of the weight of the transporter down hole and a depth meter to determine the depth at which the system is operating.

Prior to transporter engagement with the S-drive unit, a removeable first holding device can be manually applied to the upper broken end of the transporter. This holding device is solidly attached to the well head station. Once the endless transporter is ready to be reconnected, a second holding device is used, being hinged so as to provide flexible tension adjustment for the transporter, so that the tension or weight of one side of the transporter is transferable to the other side. The second holding device can be operated so as to gradually shift the tension to the other side of the transporter.

Preferably, the rotational mounting device for the transporter reels is provided with an automatic tension adjustment to provide smooth, controlled feed-out or take-in of the transporter. Such a tension adjustment may take the form of a hydraulically driven, automatic rewind mechanism.

The present invention also comprises a method for installing and modifying the evacuation system of the present invention by the use of the apparatus described herein.

The evacuation system of the present invention has also been improved to provide more efficient recovery of the oil in low or marginally producing oil wells. The design of the transport units has been improved by placement of triple transverse ribs on the exterior surface of the units to act as additional collectors of oil. In addition, these ribs advantageously scrape the interior surface of the well casing to remove oil found thereon, at the same time providing sacrificial wear and protection for the unit itself. The unit has also been provided with a metal insert to facilitate connection to the transporter flange by means of a suitable fastener, such as a rivet. This insert ensures a secure connection to the transporter and facilitates replacement of the unit on the transporter itself.

Evacuation of the transport unit at the well head station has been improved by the use of a spring-loaded concave roller. As the transport unit is driven past the roller, the concavity of the roller provides an exit for the oil and other material found within the unit. The exit comprises a portion, namely, one corner, of the opening of the unit. That is, as the engagement between the roller and the unit progresses from top to bottom, materials are forced out of the unit from the same opening in which they originally entered. The well head station has also been provided with exterior wiping blades for moving oil which is attached to the exterior surfaces of the transport unit and transporter.

The down hole module portion of the evacuation system is provided with a unique excavator device which is actually powered by the transporter. The transporter turns on an upper sprocket and passes through the interface between the upper and a lower sprocket. Thus, the transporter, which is driven by a motor and main drive sprocket at the well head station, drives the lower sprocket which in turn acts as an excavation device to improve the evacuation of the oil well. The upper sprocket can also be replaced by a roller to improve transporter alignment and contact.

The transporter may carry transport units spaced at various intervals according to the production requirements of a particular well. Thus, in a system where the transporter is comprised of a roller chain, a pair of transport units may be found at every other link, at every second link, at every third link, etc. In addition, there is frequently an advantage to running large sections of bare roller chain through the well since the chain itself serves as an effective evacuator of oil. In this instance, guide transport units are provided in order to maintain transporter alignment at the well head and to prevent interference between the entrance and exit sides of the transporter.

In addition, the well head station may also be provided with a drive motor of various power output capabilities in order to permit variable production rates. However, a typical drive motor requires only one horsepower versus the 10–40 horsepower required by prior art sucker rod systems. Further production versatility is achieved by connecting the drive motor to a clock. For steam flooded wells, the well head station is enclosed in a pressure-tight tank having an O-ring type gasket or seal.

BRIEF DESCRIPTION OF THE DRAWINGS

FIG. 1 is an overall perspective view of a vehicle and trailer on which is mounted the apparatus of the present invention for installing and modifying oil well evacuation systems. The trailer is shown detached from the vehicle. The rear of the vehicle is adjacent the well head station which is located at the well head or surface of the well ad forms a part of the oil well evacuation system.

FIG. 2 is a partial, perspective view of the rotational and translational mounting system for the transporter reel which is partially shown in dot, dash lines.

FIG. 3*a* is a perspective view of a portion of the transporter, in this case a double width roller chain, illusrating the transport units or cups for evacuating oil and other material from the well, the transverse ribs on the exterior of the units, and the flanges on the chain for the attachment of the transport units.

FIG. 3*b* is a perspective view of the metal inserts which are molded into the transport units for attachment to the roller chain flanges.

FIG. 3*c* is a partial perspective view of the interior side of a transport unit illustrating in dotted lines the position of the metal insert for use in attaching the transport unit to the flange of the transporter.

FIG. 4 is a partial perspective view taken along line 4—4 of FIG. 1 illustrating a transporter reel, its cradle mounting, and the multiple reel compartments for transporter storage and take-up.

FIG. 6 illustrates the wiper devices mounted on the well head station of FIG. 5 for removing oil from the exterior surfaces of the transport units and transporter and the oil collection pan below.

FIG. 7 illustrates a pair of concave rollers mounted on the well head station showing the manner in which they engage and evacuate the transport units.

FIG. 8 illustrates in more detail the roller/transport unit engagement of FIG. 7 and the exit provided in the opening of the transport unit for the oil and other materials contained therein.

FIG. 9 is a partial perspective view illustrating the positioning of the fixed holding device at the well head for one of the broken ends of the transporter.

FIG. 10 is a cross-sectional view taken along line 10—10 of FIG. 9 illustrating the fixed holding device.

FIG. 16 is a partial perspective view of the down hole module utilized in connection with the oil well evacuation system.

DETAILED DESCRIPTION OF THE INVENTION

Vehicle and Trailer

Figure 5:
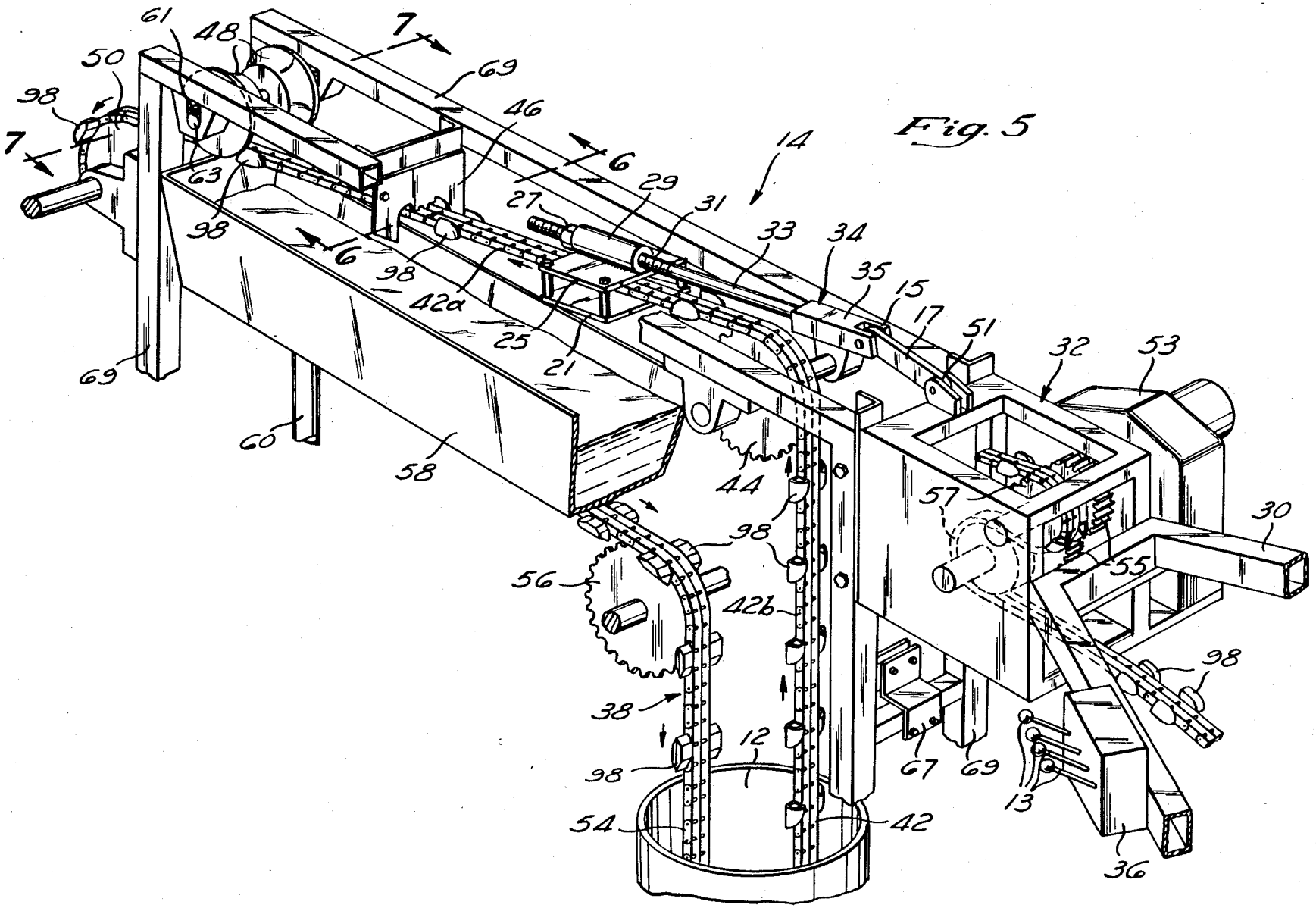
FIG. 5 is a perspective view taken along line 5—5 of FIG. 1 illustrating the well head station and the transporter in endless belt fashion exiting and entering the well and undergoing various oil removal operations. Also known in FIG. 5 is the S-drive unit mounted on the vehicle of FIG. 1 and the fixed and movable holding devices used in installing or modifying the transporter of the evacuation system.

Referring to FIG. 1, there is shown a vehicle 10 on which are mounted the various apparatus of the present invention for performing installation and modification operations on an oil well evacuation system, a portion of which is shown schematically positioned at the surface or well head 12 of an oil well. The surface portion of the oil well evacuation system shown in FIG. 1 is referred to as the well head station 14. The vehicle 10 is shown adjacent the well head station 14 where the various operations are performed on the oil well evacuation system. The well head station 14 is supported by a frame surrounding the well head which is not shown in FIG. 1.

At the bottom of the well there is located a down hole module (not shown in FIG. 1). An endless belt transporter 38 circulates between the well head station 14 and the down hole module to evacuate the well.

The oil well evacuation system, in addition to the improvements described herein, is described in more detail and claimed in applicant's co-pending application, Ser. No. 576,970, filed Feb. 3, 1984, now U.S. Pat. No. 4,552,220, entitled "Oil Well Evacuation System", which is incorporated by reference.

A trailer 16 for use in association with the vehicle 10 of FIG. 1 is shown at the well head site adjacent the vehicle and the well head station 14. Thus, the vehicle 10 and trailer 16 of the present invention are easily positioned adjacent a well 12 in order to perform the necessary operations on the oil well evacuation system. Naturally, for transportation purposes, the trailer 16 is attached to the vehicle 10.

Shown in the flat bed portion of the vehicle, immediately behind the cab, in the hydraulic reservoir 18 for the hydraulic system of the vehicle 10 which powers the various apparatus described below. Mounted near the rear of the flat bed is a large crane 20 for use in placement of the transporter reel 22 shown mounted on a generally U-shaped mounting device 24 at the rear of the vehicle. The transporter reel 22, during transit, is mounted on a carriage 26 on the trailer 16, which carriage supports the axle 28 of the reel 22.

Extending from the rear of the vehicle is a generally V-shaped boom 30 which is positioned adjacent the well head station 14, as shown in FIG. 1. Mounted on the end of the boom 30 and immediately adjacent the well head station 14 is an S-drive unit 32, the purpose and function of which will be described in more detail below. The crane 20 is also used to mount the S-drive unit 32 in position at the end of the boom 30. During transit or when not in use, the S-drive unit 32 is stored on the vehicle 10 adjacent the hydraulic reservoir 18. Extending upward from the S-drive unit 32 is the movable holding device 34 whose purpose and function will be described in greater detail below. Immediately adjacent the S-drive unit 32 and mounted on the boom 30 is the hydraulic control box 36 having four individual hydraulic levers 13.

Shown schematically in FIG. 1 is the oil well evacuation system of the present invention including an endless belt-type transporter 38 which travels in the direction of the arrows in entering and exiting the well 12. The transporter 38 carries transport units 98 or cups for evacuating oil, water, and other materials from the oil well. The units 40 will be described in more detail below. They are open at one end to permit them to be filled with oil and other matter at the bottom of the well and the bring it up to the surface, thus evacuating the well. The exit side 42 of the transporter 38 is shown passing over an idler 44 and then through the wiper device 46 just before it is engaged by a pair of evacuation rollers 48 which evacuate the transport units 98. The main drive sprocket 50 is shown being powered by a variable output motor 52. The return or entrance side 54 of the transporter 38 passes over a second idler 56 before entering the well 12. Oil collected from the transporter 38 accumulates in a collection pan 58 and is pumped to a storage tank (not shown) through a conduit 60.

The trailer 16 shown in FIG. 1 is attached to the rear of the vehicle 10 by means of a hitch 62. In order to hitch the trailer to the vehicle, the crane 20 is first utilized to remove the transporter reel 22 from its mounting device 24 for replacement on the trailer in the carriage 24 provided. In order to accomplish this, the axle 28 of the reel 22 is placed in the cradle 64 which is located at the apex of the carriage 26. The crane 20 is also used to remove the S-drive unit 32 from the well head station 14 and from the end of the boom 30 and replace it at its storage position adjacent the hydraulic reservoir 18. The boom 30 is then lifted to an upright position (not shown) so that the trailer 16 may be hitched to the rear of the vehicle 10.

As shown in FIG. 1, the trailer 16 may accommodate up to three transporter reels 22. Each reel 22 is provided with a multiple compartment configuration which provides storage for four sections of transporter 38. Preferably, each compartment can accommodate 250 feet of transporter. Thus, a vehicle and trailer combination can provide 3,000 feet of transporter, which represents 1,500 down hole feet of transporter taking into consideration that there is essentially 1,500 feet on the entrance side 54 of the transporter 38 and 1,500 feet on the exit side 42 of the transporter 38. At the rear of the trailer 16, there is a space provided for mounting the well head station 14 and the down hole module 66.

Thus, the vehicle and trailer combination provide an efficient, self-contained apparatus for the installation and modification of oil well evacuation systems.

FIG. 2 illustrates the U-shaped mounting device 24 for the transporter reel 22 which is partially shown in dot, dash or phantom lines, including the four compartmets 22*a*–22*d* of the transporter reel 22. FIG. 4 illustrates the cradle mounting 68 of the reel 22 which is partially shown in solid lines. Referring first to FIG. 2, the mounting device 24 is cantilevered at a pedestal 70 mounted in the flat bed of the vehicle 10. Rising from the pedestal 70 is the crane 20 shown in FIG. 1. The mounting device 24 is itself mounted for translational movement by means of a horizontal rod 72 journaled in a pair of bearings 74 cantilevered on the pedestal 70 of the crane 20. Extending rearwardly from this rod are a pair of triangular arms 76 which end in a U-shaped cradle 68 for receiving the axle 28 of the transporter reel 22, as shown in FIG. 4. Each cradle 68 has an associated pin 78 for preventing the unintentional removal of the axle 28 from the cradle 68, the pin 78 being inserted through the openings at the upper points of the cradle 68 and over the axis 28.

The rod 72 is translated horizontally by means of a hydraulically powered cylinder 80 just below and essentially parallel to the rod 72. The translation of the mounting device 24 is provided in order to obtain accurate alignment of the transporter on the reel with the well head. The mounting device 24 also rotates about the rod 72 and bearings 74 to that it can be moved upwardly to provide room for attachment of the trailer 16.

Rotational movement of the transporter reel 22 is provided by a hydraulic motor 82, shown in FIG. 2, located on one of the triangular arms 76 of the mounting device 24 and adjacent the axle cradle 68. The hydraulic feed and return lines 84 are also shown in FIG. 2. The axle 28 of the reel 22 is inserted within the drive shaft 90 of the hydraulic motor 82 and a pin 86 is inserted through the coupling 88, as shown in FIG. 4. Thus, rotational movement of the drive shaft is imparted to the axle 28 of the reel 22.

Four pairs of nibs 92 (FIG. 4) are found mounted on the axle 28 of the transporter reel 22 for engagement with one end of the transporter length which is stored in each compartment 22*a*–22*d* of the reel 22.

The hydraulic nature of the motor 82 easily permits reversability in the direction of rotation for the reel 22 in order to provide either feed-out or feed-in of the transporter 38 with respect to the reel 22. In addition, the hydraulic motor 82 is provided with a unique automatic tension device which prevents slack in the transporter 38 as it is being either reeled out or taken in. Preferably, the automatic tension device takes the form of an automatic rewind 94 feature that provides resistance to the rotation of the transporter reel 22 in order to prevent slack. In other words, if it is desired to unwind transporter 38 from the reel 22 or to feed out the transporter 38, the automatic tension device provides resistance to that directional rotation. Thus, the automatic tension device 94 tends to cause the reel 22 to rewind in the opposite direction that the reel is rotating. This rewind feature is accomplished by diverting a portion of the hydraulic fluid to provide rotation in the opposite direction of the main flow of fluid. This rewind feature provides a small degree of tension desirable to prevent excess transporter feed-out.

Transporter and Transport Units

FIG. 3*a* illustrates the configuration of the transporter 38 shown schematically in FIG. 1. It takes the form of a double-pitch, double-width roller chain 94 on which are mounted a series of flanges 96. Mounted on the flanges 96 are the transport units 98 which are cup-like in nature.

The transport units 98 travel in the direction of the arrow in FIG. 3*a* and enter the well in an inverted position; that is, with the opening 99 facing downward. The transporter 38 carries the transport units 98 down to the bottom of the well where they turn around by means of the down hole module 66, shown in FIG. 16 and described in more detail below. While rising through the well, the units 98 are filled with oil, sand, water, and other materials in the well and bring them to the surface, thus evacuating the well. The transport units 98 are then themselves evacuated by means of the apparatus illustrated in FIGS. 5–8 and described below, and then reenter the well to complete the endless belt evacuation system.

Each transport unit 98 is comprised of essentially three sides, a closed bottom and an open top 99. The size of the transport unit 98 may be varied depending on the size of the well bore and production requirements. Referring to the orientation of the units shown in FIG. 3*a*, the interior side 99 faces the links of the roller chain 94 comprising the transporter 38 and forms a substantially right angle with the lower side 95. The interior and lower sides 99 and 95 are relatively more rigid than the peripheral side 93, whose curvature connects the interior and lower sides 97 and 95 and also forms the bottom of the unit. The peripheral side 93 is advantageously soft and pliable in order to facilitate the evacuation of the transport unit 98, as described in more detail below.

Each transport unit 98 is provided with plural ribs 91 which are transverse to the longitudinal axis of the units 98. These ribs 91 are found on the curved peripheral side 93 of the units which engage the interior casing of the well in order to remove oil found thereon. The ribs 91 also provide additional wear pads for the units in order to prevent premature deterioration. In addition, the units 98 have enlarged shoulders 89 at each edge of the peripheral side 93 to improve wear.

FIGS. 3*b* and 3*c* illustrate in more detail the manner in which each transport unit 98 is mounted on the flange 96 extending from the link of the roller chain 94. In constructing the transport unit 98, the metal insert 87 shown in FIG. 3*b* is molded into the lower side 95 of the unit 98 as, as shown in dotted lines in FIG. 3*c*. The metal insert 87 is provided with a pair of lateral inclined flanges 85, four upright members 83, and four openings 81 in order to ensure a secure engagement with the lower side 95 of the unit 98.

A fifth hole 79 in the insert 87 is provided for attachment to the hole 77 of the flange 96. The lower side 95 of the unit 98 is provided with a slotted opening 75 (FIG. 3*c*) into which the flange 96 is inserted. The slot 75 extends far enough into the lower side 95 of the unit 98 in order to expose the fifth hole 79. A rivet or other suitable fastener 73 can then be inserted up through the bottom of the lower side 95, and through the flange 96 in order to attach it to the transporter 38.

The transport units 98 may be placed on the transporter 38 in volumes which will vary with the production needs of each individual well. For example, transport units may be placed at every link of the transporter or at every other link, as shown in FIG. 3, or at every third link, etc. In addition, the power requirements for the motor 52 driving the drive sprocket 50 (FIG. 1) may also vary according to the production requirements. Furthermore, the oil well evacuation system may be electrically connected to a clock mechanism (not shown) which will automatically activate the drive motor 52 at various times of the day and for different periods of time. This flexibility is necessary in order to achieve maximum production from the peculiar problems associated with a particular low or marginally-producing oil well.

It has also been found advantageous to leave relatively long sections of bare transporter 38 or roller chain 94 without any transport units 98. For example, in one embodiment of this aspect of the invention, sections of 50 feet of bare roller chain are separated by 50-foot sections of chain having transport units 98 attached to the chain 94. This configuration is particularly advantageous where the viscosity of the oil is such that it collects very easily on the chain itself. The transport units 98 are then used to evacuate the well of sand, water, and other undesirable by-products.

Figure 15:
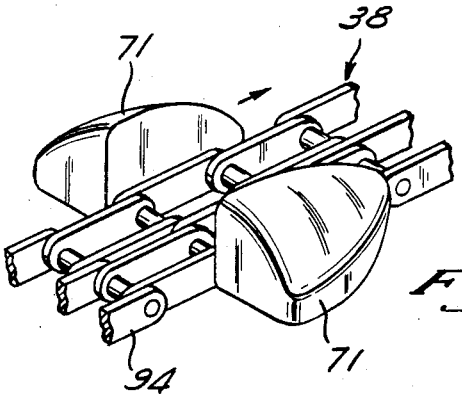
FIG. 15 is a partial perspective view illustrating the guide units for the transporter.

In this configuration, each section of transporter 38 bearing the transport units 38 is provided with two, three, four, or more pairs of guide units 71, shown in FIG. 15 which are utilized to avoid any interference between the entrance and exit sides of the transporter. In this arrangement, the two sections of the transporter 38 have a tendency to turn or twist, sometimes causing interference in the well bore. The guide units 71, are tapered downwardly in the direction of travel as indicated by the arrow in FIG. 15, and provide a smooth leading edge in order to avoid any such interference. These guide units 71 do not have openings and therefore are not capable of collecting oil or other matter. Preferably, a pair of guide units 71 are attached to the transporter 38 at the lead and trail ends of the transporter section having transport units 98 as well as in the middle.

The downhole module 66 is shown in FIG. 16. It is provided with a roller or a sprocket 5 which provides a turn-around location for the transportation 38. The roller chain 94 in turn drives a lower sprocket 7 which provides means for excavating the contents of the bottom of the well.

Well Head Station

The evacuation of the transport units 98 at the well head station 14 is shown illustrated in FIGS. 5–8. FIG. 5 comprises an overall view of the well head station 14 including a portion of the well head station housing or frame 69 which has been broken away to illustrate the details of the evacuation system.

The well head station 14 is positioned above the well head 12, as illustrated in FIG. 1. With reference to FIG. 5, the exit side 42 of the transporter 38 is shown on the right while the entrance side 54 of the transporter 38 section is shown on the left. To the right of the well head station 14 is illustrated the S-drive unit 32 which is used in performing certain operations in the transporter 38. The S-drive unit 32 is mounted on the end of the boom 30 extending from the rear of the vehicle 10, as illustrated in FIG. 1. Extending further rearwardly from the S-drive unit 32 and engaging the transporter 38 is the moveable holding device 34. A fixed holding device 69 is shown in FIG. 5 mounted on the frame 69 of the well head station 14 and below the S-drive unit 32. The use and function of these devices will be described in more detail below.

As shown in FIG. 5, the exit side 42 of the transporter passes over an idler sprocket 44 and begins a downhill or inclined descent above an oil collection pan 58. The oil collection pan 58, which is shown broken away in FIG. 5, extends beneath the idler sprocket 44 since a significant amount of oil is collected in the roller chain 94 of the transporter itself. As it passes over the sprocket 44, this oil is forced off of the transporter and collected advantageously by the collection pan.

During its downward descent, the transporter and associated transport units 98 will begin to empty their contents into the collection pan 58. The transporter first passes through a wiper device 46, as illustrated in more detail in FIG. 6. This device comprises a semirigid material 65, such as rubber or plastic which completely engages the exterior of the transport units 98 and the transporter 38. A significant amount of oil is collected on these exterior surfaces. The wiper device 46 removes this exterior oil for collection in the pan, as shown in FIG. 6.

The transporter then passes beneath a pair of spring-loaded rollers 48, mounted near the left end of the well head station 14 as shown in FIG. 5. The rollers 48 are shown in more detail in FIGS. 7 and 8. Each roller 48 is mounted for engagement with one series of transport units 98, as shown in FIG. 7. The rollers 48 are mounted on a common axis 63 which is spring-loaded 61 for positive engagement against the transport units 98. The purpose of the rollers 48 is to evacuate the contents of the transport units 98. As the roller 48 engages the leading edge or opening 99 of each unit 98, the contents are forced toward the bottom of the unit and are pressurized therein since there is no escape or relief for the pressure. However, as the units 98 continue to pass under the roller 48, this pressure is transferred gradually toward the opening 99 of the unit, thus forcing the contents outward through the opening 99, as shown in FIG. 8.

The concave configuration of the interior periphery 59 (FIG. 8) of each roller 48 provides a non-depressed area near the upper portion of the peripheral side 93 of the unit 98 where the contents may be evacuated under pressure. The curvature of the circumference of each roller 48 is sufficient to maintain the lower portion of the peripheral side 93 substantially closed at a given instant, thus forcing the contents of the unit out of the upper opening 99 shown in FIGS. 7 and 8. The concave periphery 59 of the roller 48 forms a channel for the escape of the contents of the unit 98 under pressure.

Referring again to FIG. 5, after passing under the rollers 48, the transporter 38 passes around the drive sprocket 50. The transporter 38 then becomes the return or entrance side 54 which passes over the lower idler 56 before re-entering the well head 12.

Thus, the well head station 14 and the apparatus described herein and shown in the drawings, provide an efficient mechanism for evacuating the oil and other materials found in low or marginally-producing oil wells.

S-Drive Unit and Holding Devices

FIGS. 5 and 9–12 illustrate the S-drive unit 32 and associated holding devices 34 and 67 which facilitate the installation and modification of oil well evacuation systems described above. As shown in FIG. 1, the S-drive unit 32 has an essentially cubic configuration and is mounted at the end of the boom 30 extending rearwardly from the vehicle 10. A portion of the boom 30, including the hydraulic control panel 36 and individual control levers 13 (FIG. 5), which operate the rotation of the S-drive unit 32, the reel 22, and the crane 20.

By means of a pair of adjacent sprockets 57 (FIG. 5), the S-drive unit 32 provides positive holding or locking forces for the transporter 38, as well as a positive drive feature. A portion of a transporter 38 is shown encircling the upper sprocket and is shown in phantom lines encircling the lower sprocket, thus forming the letter "S." Each sprocket 57 has an associated gear 55, including upper and lower gears, which are mounted on a common axis with their associated sprocket 57. These gears 55 are in turn powered by means of a hydraulic motor 53 which is mounted on one side of the S-drive unit 32 and adjacent the sprocket axes. The two gears 55 drive one another so that their interengagement locks the transporter 38 in place and provides the holding and driving functions.

When the S-drive unit 32 is in a holding or locking mode, the hydraulic fluid supplied to the motor 53 is channeled so as to prevent the rotation of the gears 55, thereby preventing rotation of the sprockets 57. This configuration serves as a hydraulic brake to prevent unintended movement of the transporter 38 while in this holding or locking function. On the other hand, when it is desired to positively drive the transporter 38 in either direction, the hydraulic fluid is supplied to the gears 55 in the appropriate direction so as to impart rotation to the sprockets 57.

It can be appreciated from FIG. 5 that when the transporter 38 is in the endless belt configuration as shown in solid lines, the weight of the exit side 42 of the transporter is balanced in tension by the weight of the opposite or entrance side 54 of the transporter. Thus, the upper idler 44 and drive sprocket 50 provide mainly a support function which must be necessary to resist the weight of the two segments 42 and 54 of transporter 38. In turn, when the movement of the transporter 38 is desired, because of this tension balance between the two sides of the transporter, very little power is necessary to produce movement.

For example, in the normal operation of the oil well evacuation system, the exit side 42 of the transporter would move upward in the direction of the arrow in FIG. 5 and the drive sprocket 50 would rotate counterclockwise in the direction of the arrow, thus causing the entrance side 54 of the transporter to move downward in the direction of the arrows. If it is desired to produce this circulatory movement in the endless transporter, a very small amount of power must be imparted to the drive sprocket 50 by the drive shaft and motor 52 (not shown in FIG. 5) in order to simply begin the lifting of the exit side 42 of the transporter. At the same time, however, the weight of the entrance side 54 of the transporter will cause it to pull or fall downwardly by force of gravity, thus facilitating the lifting of the exit side 42. Thus, when the transporter is in the endless belt configuration it provides much of its own holding power by means of this tension balance.

However, if for any reason the transporter is broken to remove the endless belt configuration, each side of the transporter is extremely heavy and requires positive and secure holding devices. The lack of an endless belt configuration may occur, for example, when the well head station 14 is initially being installed and the transporter is being initially fed into the system in connection with the down hole unit 66. Alternatively, the endless belt configuration may be broken after initial installation of the evacuation system to repair or modify the transporter.

FIG. 5 illustrates the positive holding devices 34 and 67 which are utilized to hold the broken ends of the transporter during such installation or modification procedures. A moveable holding device 34 extends rearwardly from the S-drive unit 32, as shown in FIG. 1. Although shown engaging the transporter 38 in FIG. 5, the moveable holding device 34 may be lifted up out of the way as shown in FIG. 1. This movement is made possible by a pivotable mounting 51 on the S-drive unit 32 as shown in FIG. 5. FIG. 5 also illustrates a fixed holding device 67 which is mounted on the frame 69 of the well head station 14 just below the S-drive unit 32. Thus, the transporter 38 may be broken somewhere on the exit side 42, preferably on the center of the upper idler 44. The inclined portion **42*a* of the transporter broken end is then held by the moveable holding device 34 while the lower, vertical portion 42*b* of the transporter is held by the fixed holding device 67**.

The fixed holding device 67 is shown in more detail in FIGS. 9 and 10. As shown in a side view of FIG. 10, the fixed holding device 67 has a configuration similar to a small "h" or a chair. It includes a lower mounting portion 49 and an upper holding portion 47. The lower mounting portion 49 is essentially a U-shaped device which clamps over a horizontal bar on the frame 69 of the well head station 14. A fastener 45 is mounted below the horizontal bar 69 in order to securely mount of the holding device 67 on the bar. The upper holding portion 47 is essentially vertical and has three holding teeth 43 which are slightly upwardly inclined with respect to the plane of the vertical portion 47 (FIG. 10). These teeth engage the rollers 41 of the transporter 38, as shown in FIG. 10 in order to supply secure holding for the lower broken end **42*b* of the transporter. The inclination of the teeth 43 prevents vibration or other accidental removal of the transporter from the holding device 67. In other words, the force of gravity acting on the transporter provides a secure holding force with respect to the teeth 43 of the holding device. A backing plate 39 is mounted over the teeth and is secured to the vertical portion by means of a pair of fasteners 37, as shown in FIG. 9, in order to further prevent any possible removal of the transporter 38 from the fixed holding device 67**.

Figure 11:
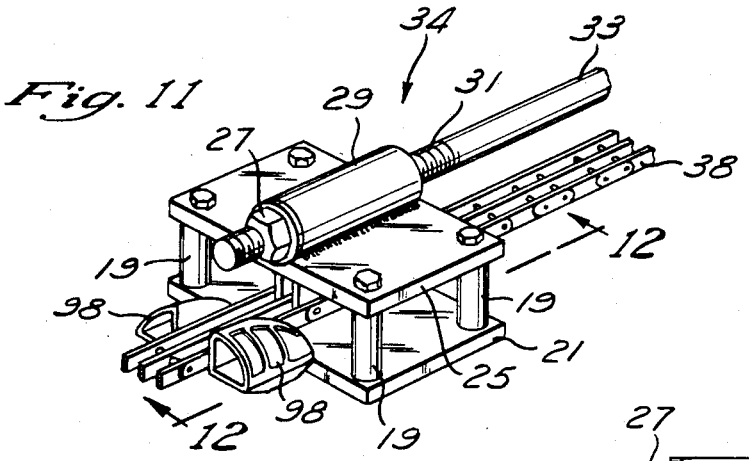
FIG. 11 is a partial perspective view illustration in more detail the movable holding device shown in FIG. 5.
Figure 12:
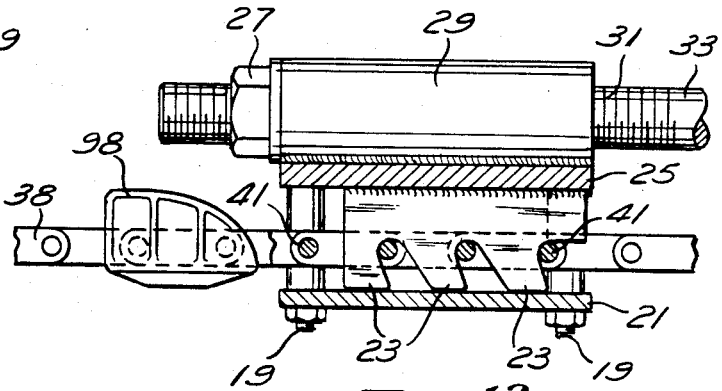
FIG. 12 is a cross-sectional view of the movable holding device taken along line 12—12 of FIG. 11.

The moveable holding device 34 is shown in more detail in FIGS. 5 and 11–12. In addition to its pivotable mounting 51 on the S-drive unit 32, the moveable holding device 34 is provided with an articulating joint 35 about which it may bend. Extending rearwardly from the joint 33 is a rod having a threaded end 31. The threaded end 31 passes through an un-threaded cylinder 29 and is retained therein by means of a nut 27, Since the cylinder 29 slides freely over the threaded end 31 of the rod 33, movement of the nut 27 to the left or right will permit the cylinder 29 to move to the left or right. The cylinder 29 is securely fastened to one side of a holding plate 25, as shown in FIG. 11. Extending out from the opposite side of the holding plate 25, in a fashion similar to the fixed holding device 67, are three inclined teeth 23 which engage the rollers 41 of the transporter 38, as shown in FIG. 12. The purpose of the teeth 23 is to securely hold the transporter in position. The direction of the inclination is due to the inclination of the transporter at the location of the moveable holding device 34, which is shown in FIG. 5. Thus, this inclination tends to again utilize the force of gravity and the tension applied to the transporter to retain it within the teeth 23 of the holding device 34. A protective backing plate 21 is also applied over the teeth 23 to prevent removal of the transporter and is held thereto by means of four fasteners 19 shown in FIGS. 11 and 12.

Articulation of the moveable holding device 34 is provided by the joint 25 (FIG. 5). The joint 35 is comprised of a connecting rod 17 which is pinned at one end to a forked member 15 which is rigidly connected to the rod 33. The left end of the connecting rod 17 is pinned within the fork 15 in order to permit pivoting or articulation of the joint 35. The right end of the connecting rod 17 is pivotally mounted on the upper side of the S-drive unit 32.

This articulation advantageously permits the moveable holding device 34 to accommodate different positions in the inclined or upper segment 42*a* of the transporter 38. As shown in FIG. 5, which illustrates the transporter in an endless loop configuration, the joint 35 articulates upward so that the holding plate 25 (FIGS. 5, 11–12) of the moveable holding device 34 is substantially parallel to the inclined segment 42*a* of the transporter 38. However, if the transporter were to be broken at approximately the exit side 42*b* thereof, the tension on the transporter may cause the inclined segment 42*a* to pull downward, thus requiring the articulation of the joint 35 and the moveable holding device in order to securely hold the broken end 42*a* of the transporter.

The moveable holding device 34 also permits the gradual transfer of the tension force in the transporter when it is broken or in a non-endless belt configuration to the other segment of the transporter. When the transporter is in the broken configuration, it is preferable to break the transporter at the exit side 42 thereof just above the fixed holding device 67. Thus, the moveable holding device 34 is attached to the upper broken end 42*a* of the transporter in the position shown in FIG. 5 while the fixed holding device 67 is securely attached to the opposite or lower broken end 42*b* of the transporter as illustrated in FIGS. 9 and 10.

When it is desirable to once again complete the endless configuration of the transporter, the two broken ends 42*a* & 42*b* can be brought together, with the holding devices 34 & 37 still in place to bear the tension in each segment of the transporter, and the appropriate links of the roller chain 64 can be completed in order to complete the endless configuration. However, if the tension in the ends of the transporter is suddenly transferred to the opposite side of the transporter, it could easily result in breakage of the roller chain. Accordingly, it is desirable to gradually transfer this tension.

This is accomplished by the moveable holding device. The nut 27 of the moveable holding device 34 is gradually turned on the threaded end 31 of the rod 33 in order to move the holding plate 25 rearwardly or to the left in FIG. 5. This eliminates the slack in the transporter 38 between the holding devices 34, 67, thus applying tension to the newly joined segment 42*b* of the transporter. When sufficient tension has been achieved, both holding devices 34 & 67 can be removed and the evacuation system is now ready for operation.

It should be clear that when the transporter is an endless belt and the moveable holding device 34 is bearing the weight of the entrance side 54 of the transporter and the resultant tension in the upper broken end 42*a*, the movement of the nut 27 to the right or left will gradually decrease or increase, respectfully, the amount of that tension that is borne by the lower broken end 42*b*. Thus, the tension can be gradually transferred to avoid breakage or injury. At the same time, the joint 35 permits movement of the moveable holding device 34 during this transfer process until sufficient tension is obtained to permit removal of the teeth 23 and the lifting of the holding device 34 as shown in FIG. 1.

Thus, the S-drive unit 32 and the moveable holding devices 34 & 67 provide simple and yet secure means for performing operations on the transporter of the oil well evacuation system.

Operation

Figure 13A:
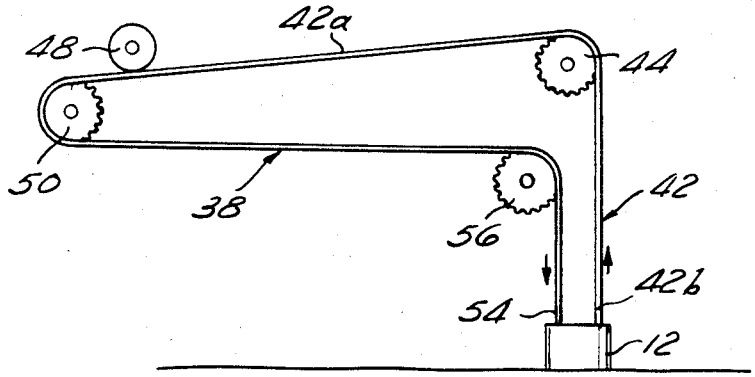
FIGS. 13*a–d* are schematic illustrations of the method of the present invention relating to the modification of an installed evacuation system.

The operation of the S-drive unit 32, the holding devices 34 & 67, and this tension transfer process, can be described in more detail with reference to FIGS. 13*a–d* which schematically illustrate the modification of an evacuation system which was previously installed in a well. FIG. 13*a* illustrates only the exit 47 and entrance segments 54 of the transporter 38 and the upper 44 and lower 56 idlers over which they pass. Also shown for reference is the roller 48 for evacuating the contents of the transport units 98 and the drive sprocket 50. Movement of the transporter is in the direction of the arrows shown in FIG. 13*a* which is the same as in FIG. 5.

If, for example, it is desired to remove a segment of the transporter 38 and replace it with another transporter having more or fewer transport units 98, or to add additional length 38*a* of transporter in order to permit an increase in depth at which the down hole unit 66 is located, then it is necessary to break the endless belt configuration in order to add this additional length 38*a*. This is accomplished by means of the S-drive unit 32 and the associated moveable 34 and fixed 67 holding devices as shown in FIG. 13*b*.

Figure 13B:
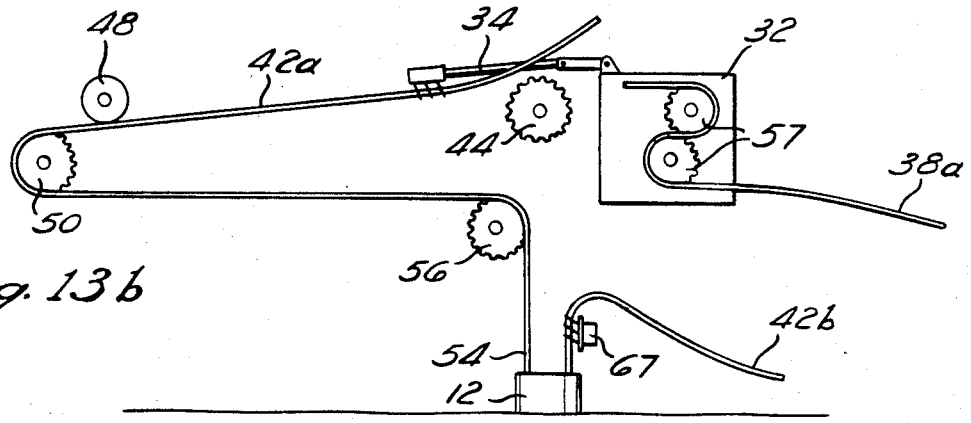

The first step in this method would be to bring the S-drive unit 32 in close association with the well head station and to fasten it securely to the frame 69 of the station, shown schematically in FIG. 13*b* The fixed holding device 67 would be also mounted on the station in a position to engage the lower exit side 42*b* of the transporter. The moveable holding device 34 would also be rotated downwardly in order to engage the upper or inclined section 42*a* of the transporter within the well head station as shown in FIG. 13*b*.

With the two holding devices in place, the nut 27 (FIG. 11) on the moveable holding device 34 is then rotated in order to cause the holding plate 25 to approach the S-drive unit, thereby creating a small amount of slack in the transporter in the upper segment 42*a* of the transporter located between the two holding devices. This slack facilitates removal of a pin 41 from the roller chain of the transporter and the breaking of the endless loop, as shown in FIG. 13*b*.

The additional length 38*a* of transporter to be added to the system can be stored on the transporter reel 22 mounted in the vehicle 10 shown in FIG. 1. The reel 22 is then aligned laterally with the well head 12 by means of the hydraulic cylinder 80. The reel 22 is then rotated to unwind the extra transporter 38*a* and to bring it into position in the S-drive unit 32.

Figure 13C:
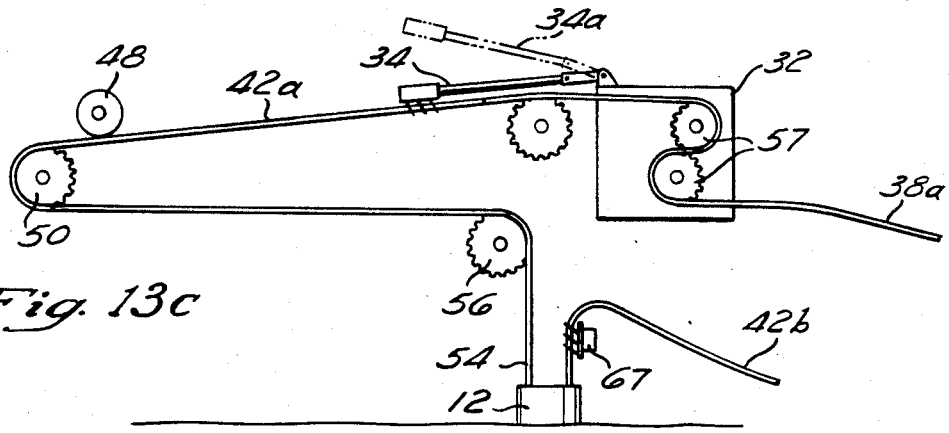

The breaking of the endless belt configuration of the transporter leaves an upper broken end 42*a* and a lower broken end 42*b*. Once the additional length 38*a* is threaded through the adjacent sprockets 57 in the S-drive unit 32, the upper broken end 42*a* can be attached to the lead end of the additional length 38*a*, as shown in FIG. 13*c*. With the drive sprocket 50 disconnected from the motor 52, the hydraulically powered gears 55 of the S-drive unit 32 then cause the additional length 38*a* to be driven down hole.

Prior to this step, the moveable holding device 34 is removed from the transporter, and placed in the raised position 34*a* shown in dot-dash lines in FIG. 13*c*. The holding device 34 is not necessary since the S-drive unit 32 provides positive holding force necessary to prevent the loss of the entrance segment 54 of the transporter down the hole.

Figure 13D:
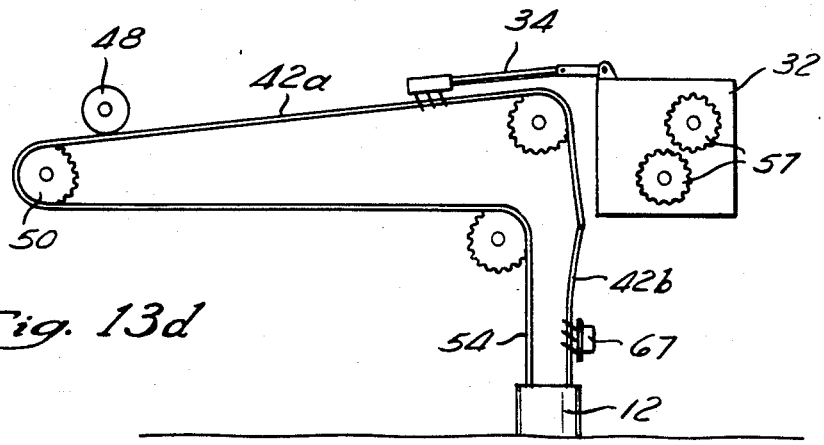

Before the trailing end of the additional length 38*a* of transporter is threaded through the sprockets 57 of the S-drive unit 32, the moveable holding device 34 is once again engaged to the upper broken end 42*a* of the transporter. The transporter 38*a* is then broken at the center of the upper idler sprocket 44 and the upper broken end 42*a* is attached to the lower broken end 42*b* in order to recomplete the endless belt configuration as shown in FIG. 13*d*. Then, nut 27 of the moveable holding device 24 can be gradually moved to the left along the threaded rod 33 to apply the tension to the newly-joined portion 42*a*, 42*b* of the transporter, as explained above. When the tension is completely applied and there is no slack between the moveable and fixed holding device 34 and 67 the moveable and fixed holding device 34 and 67 can be removed and the operation of the excavation system can continue.

The method and system described above can also be successfully utilized to remove a segment 38*a* of the transporter and to rewind it upon the transporter reel 22 by simply reversing the steps described above.

Figure 14:
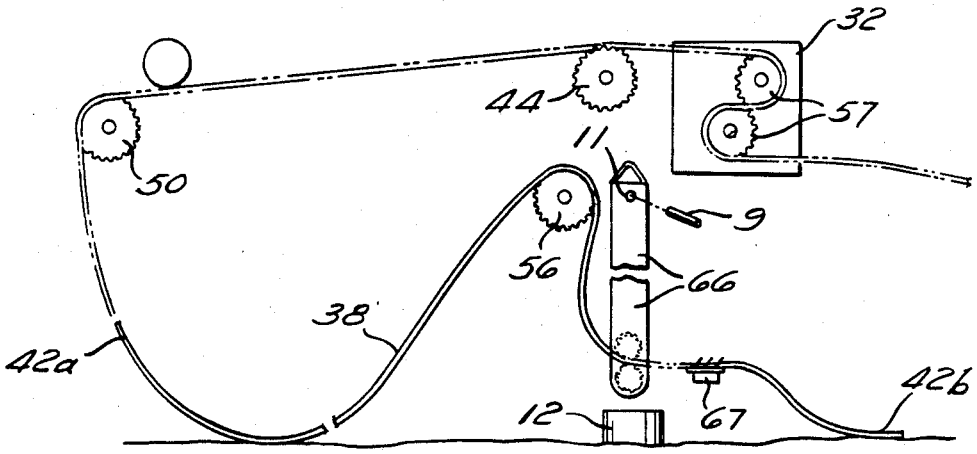
FIG. 14 is a schematic view illustrating the method of the present invention relating to the installation of an evacuation system, including the placement of the down hole module down the well.

Likewise, as illustrated in FIG. 14, a similar procedure may be followed for initial installation of evacuation system in the well. In this method, the well head station 14 is first positioned on the well head 12 and the S-drive unit 32 is attached at its appropriate location. A lead length 38 of transporter, preferably approximately 50 feet, is first fed over the lower idler 56 and through the lower sprockets 5, 7 of the down hole unit 66, which is suspended over the well bore by the crane 20. The leading end 42*b* of the transporter 38 is then attached to the fixed holding device 67. The fixed holding device 67 if next attached to the well head 12. See FIG. 14 (down hole unit 66 not to scale).

The crane 20 then lowers the down hole unit 66 into the well bore until the hole 11 at the upper end of the down hole unit 66 is even with the top of the well head 12. This hole receives a pin 9 which holds the down hole unit 66 in place approximately level with the top of the well head 12. The tail end 42*a* of the transporter 38 is then fed over the drive sprocket 50, over the upper idler 44, and through the sprockets 57 of the S-drive unit 32 as indicated by the dashed line in FIG. 14. The S-drive 32 may then be driven backwards to apply tension to the transporter 38 and to slightly lift the down hole unit 66 to permit removal of the pin 9, and then forward to lower the down hole unit 66 and the transporter 38 into the wall.

The tail end 42*a* of the lead transporter segment 38 is then connected to additional length of transporter stored on the reels 22. The transporter found in each compartment of the reel is fed serially down the hole by means of the S-drive unit 32 until the desired depth is achieved. The moveable holding device 34 is then attached to the transporter. The transporter is then broken on the upper side 44 for attachment to the lead end 42*b* of the lead length 38 of transporter still attached to the fixed holding device 67. Thus, the endless belt configuration is completed and the moveable and fixed holding devices can then be removed as described above.

The downhole unit 66, shown in FIG. 16, provides a means for excavating the contents of the well. This is particularly accomplished by means of the sprockets 5, 7, which are provided by the circulating endless belt. The lower sprocket 7 may be bladed to enhance this excavation. The unit 66 is also provided with antifriction rollers to reduce wear within the well bore, and instruments to sense down hole conditions.

In conclusion, it can be seen that the method and apparatus of the present invention greatly facilitates the installation and modification of oil well evacuation systems of the type described and shown. This apparatus and method can be utilized with a minimum number of personnel and procedures can be performed at a minimum of lost oil production time. These factors are critical in maximizing the production from low or marginally-producing oil wells which are predominant in the western United States.

What is claimed is:

1. An article for use in an oil well evacuation system having a belt circulating between a station at the head of said well and the bottom of said well, said article comprising:

a unit at the bottom of said well providing turn around means for said belt; and means on said unit for excavating dirt and sand found at the bottom of said well, said excavating means being powered by the movement of said belt around said unit.

2. An apparatus, comprising:

an elongated module for insertion into an oil well, said module having a top end and a bottom end;

a sprocket at said bottom end for receiving a roller chain; and means separate from said roller chain on said module at the bottom end of said module for agitating and excavating particulate matter in said oil well.

3. The apparatus of claim 2, further comprising means for suspending said module in an oil well.

4. The apparatus of claim 2, further comprising an instrument on said module for measuring conditions inside said oil well.

5. The apparatus of claim 2, wherein said agitating and excavating means are adapted to be driven by said roller chain.

6. The apparatus of claim 5, wherein said agitating and excavating means comprise rotatable blades at the bottom end of said module adapted to exert force on said module in the direction of the bottom of said oil well.

7. The apparatus of claim 5, further comprising a roller at the bottom end of said module situated above said sprocket so that a roller chain passing between said sprocket and said roller would simultaneously engage both said sprocket and said roller and wherein said roller chain may reverse direction about said roller.

* * * * *